US006233956B1

(12) United States Patent
Katayama et al.

(10) Patent No.: US 6,233,956 B1
(45) Date of Patent: May 22, 2001

(54) EXPANSION VALVE

(75) Inventors: Toshiharu Katayama; Kazuhiko Watanabe, both of Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/543,882

(22) Filed: Apr. 6, 2000

(30) Foreign Application Priority Data

May 11, 1999 (JP) ..... 11-130311

(51) Int. Cl.[7] ..... F25B 41/04
(52) U.S. Cl. ..... 62/197; 62/225; 236/92 B
(58) Field of Search ..... 236/92 B; 62/225, 62/197, 198

(56) References Cited

U.S. PATENT DOCUMENTS 3,150,502 * 9/1964 Tucker ..... 62/197
3,363,433 * 1/1968 Barbier ..... 62/197
3,839,879 * 10/1974 Redfern et al. ..... 62/197
4,688,390 * 8/1987 Sawyer ..... 62/197
4,741,178 * 5/1988 Fujiu et al. ..... 62/198
5,588,590 * 12/1996 Sakakibara et al. ..... 62/225
5,653,118 * 8/1997 Cocchi et al. ..... 62/197
5,836,438 * 10/1998 Ohishi et al. ..... 236/92 B
6,053,417 * 4/2000 Hotta et al. ..... 236/92 B

* cited by examiner

*Primary Examiner*—William E. Tapolcai
(74) *Attorney, Agent, or Firm*—Rader, Fishman & Grauer

(57) ABSTRACT

A valve body 10 of an expansion valve 1 comprises a valve chamber 14 to which refrigerant from a compressor is supplied. The amount of refrigerant is controlled between a valve member 40 and a valve seat 16, and travels through a first passage 20 to an evaporator. The refrigerant returning from the evaporator travels through a second passage 50 and into the compressor. The valve chamber 14 is equipped with a bypass passage which is communicated through a narrow hole 24 to an opening 26 with a bottom, and through a conduit 28 to the first passage 20. The electromagnetic valve 100 comprises a plunger 130, and opens/closes the bypass passage by a pilot valve 150. A pressure switch 220 is equipped to an opening 54 communicated to the second passage 50, and when the pressure of the refrigerant returning from the evaporator is reduced, the valve 100 is operated and the bypass passage is opened.

7 Claims, 5 Drawing Sheets

EXPANSION VALVE

FIELD OF THE INVENTION

The present invention relates to an expansion valve equipped in an air conditioner mounted on a vehicle for controlling the flow of a refrigerant travelling to an evaporator, wherein a bypass passage formed to the expansion valve is opened by an electromagnetic valve when the expansion valve is in a closed state, circulating a minimum amount of refrigerant so as to secure the lubrication of a compressor and the like constituting the refrigerant cycle.

DESCRIPTION OF THE RELATED ART

The expansion valve equipped in an air conditioner of a vehicle includes a valve chamber for controlling the flow of the refrigerant into which the refrigerant being supplied from a compressor is introduced, a first passage for guiding the refrigerant exiting the valve chamber toward an evaporator, and a second passage through which the refrigerant returning from the evaporator travels. A shaft-like valve drive member having a heat sensing function is equipped in the second passage for sensing the refrigerant temperature flowing thruogh the passage and for transmitting the sensed temperature to a valve drive mechanism called a power element. Further, the distance between a valve means and a valve seat of the expansion valve is operated so as to control the flow of the refrigerant.

SUMMARY OF THE INVENTION

According to the above-mentioned type of expansion valves, when the air-conditioning load is low, the flow path between the valve means and the valve seat is nearly closed, and only very little refrigerant flows through the valve. A lubricating oil is included in the refrigerant, which lubricates the sliding units of the compressor and the like constituting the refrigeration cycle.

Therefore, if the flow of the refrigerant circulating in the refrigeration cycle is reduced greatly, it may cause malfunction of the equipment constituting the refrigeration cycle such as the compressor due to insufficient lubrication.

Accordingly, the present invention aims at providing an expansion valve capable of circulating a minimum amount of refrigerant even when the air-conditioning load is low.

In order to achieve the above object, the present invention provides an expansion valve equipped in an air conditioner for decompressing and expanding a refrigerant and supplying the same to an evaporator, wherein a valve body comprising a first passage through which said refrigerant being transferred to said evaporator travels, a second passage through which said refrigerant returning from said evaporator toward a compressor travels, and a valve chamber equipped in said first passage into which the refrigerant enters, is further equipped with a bypass passage for supplying said refrigerant from said valve chamber to said compressor, and an electromagnetic valve for opening and closing said bypass passage, said electromagnetic valve being operated so as to open said bypass passage according to the output from a sensing means for detecting a predetermined air-conditioning load.

Preferably, the bypass passage communicates the valve chamber and the first passage. Moreover, the bypass passage communicates the valve chamber and the second passage.

In a more preferable example, the sensing means is a pressure sensor or a temperature sensor.

Moreover, the expansion valve according to the present invention is equipped in an air conditioner for decompressing and expanding a refrigerant and supplying the same to an evaporator, said expansion valve including a valve body comprising a first passage through which said refrigerant being transferred to said evaporator travels and a second passage through which said refrigerant returning from said evaporator travels, a valve chamber equipped in said first passage into which said refrigerant enters, a bypass passage for communicating said valve chamber and said first or said second passage, an electromagnetic valve for opening or closing said bypass passage, and a pressure switch equipped to said second passage, wherein said pressure switch detects the reduction of pressure of said refrigerant inside said second passage, and operates said electromagnetic valve to open said bypass passage.

Preferably, the electromagnetic valve is equipped with a plunger and a pilot valve being opened and closed by the end portion of said plunger, said pilot valve being operated to open or close a conduit equipped within said bypass passage.

The expansion valve according to the present invention defined as above realizes a valve which is capable of supplying a minimum amount of refrigerant to the refrigeration cycle even when the valve is nearly or completely closed.

DETAILED DESCRIPTION OF PREFERRED EMBODIMENTS

Figure 1:
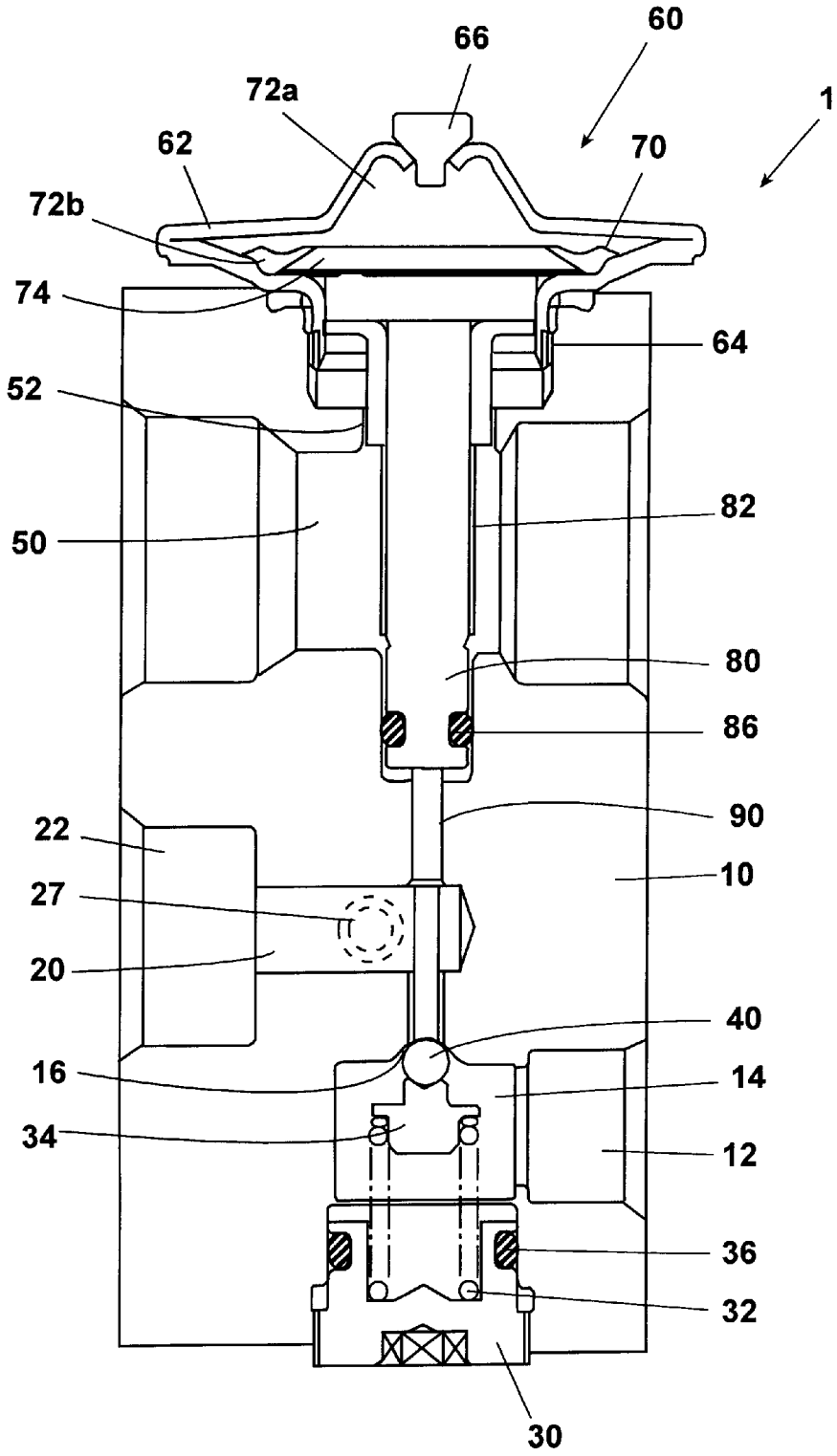
FIG. 1 is a cross-sectional view showing one embodiment of the expansion valve according to the present invention.
Figure 2:
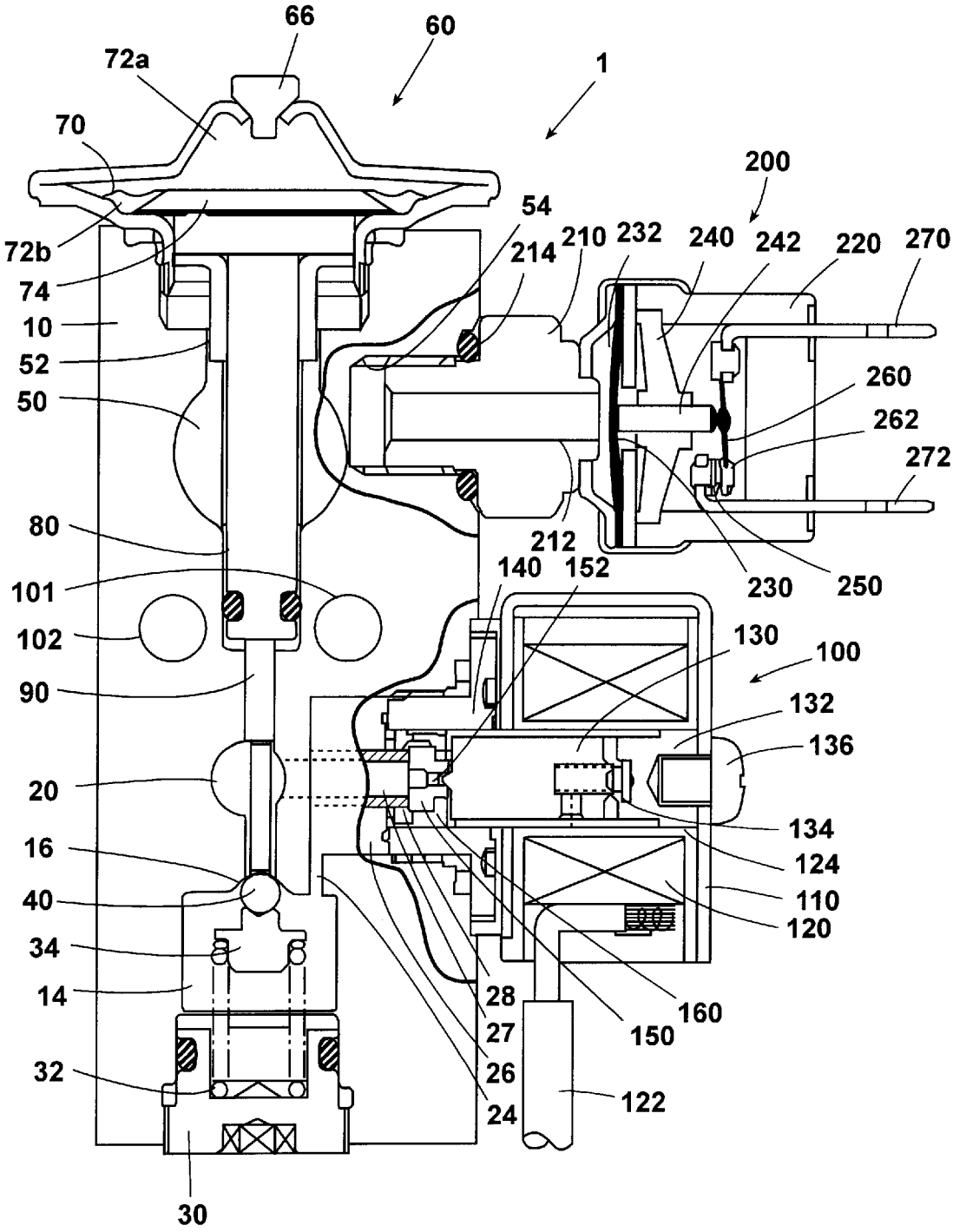
FIG. 2 is a right side cross-sectional view of FIG. 1.
Figure 3:
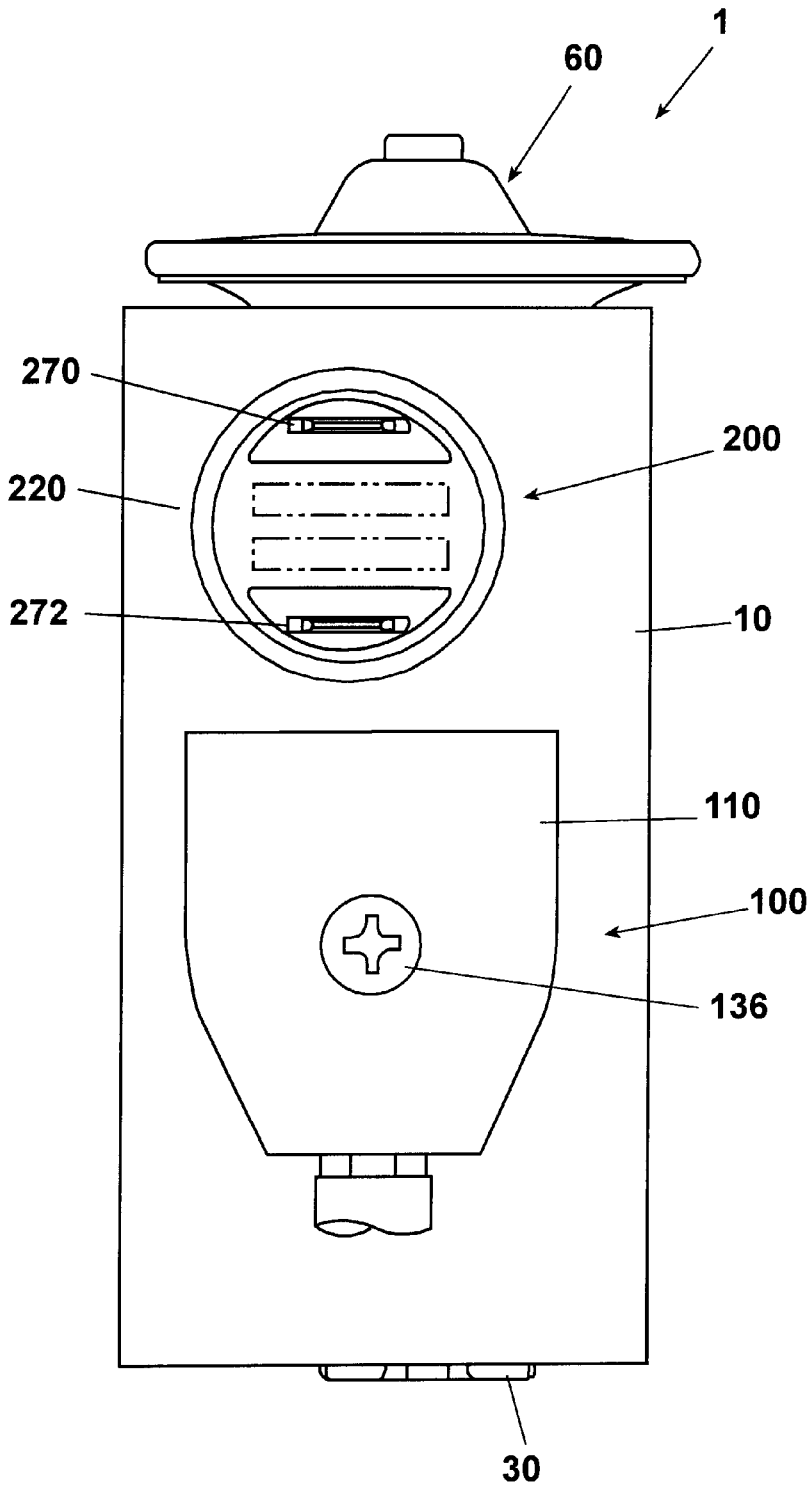
FIG. 3 is a right side view of FIG. 2.

FIG. 1 is a cross-sectional view of the expansion valve according to the present invention showing a refrigerant passage in cross-section, FIG. 2 is a cross-sectional view corresponding to the right side view of FIG. 1, and FIG. 3 is a right side view of FIG. 2.

The expansion valve shown as a whole by reference number 1 has a substantially prismatic-shaped valve body 10. To the lower portion of the valve body 10 is equipped an entrance hole 12 through which a liquid-phase refrigerant supplied from a compressor of a refrigeration cycle travels. The entrance hole 12 is communicated to a valve chamber 14. A valve member 40 is supported through a support member 34 by a spring 32.

A nut member 30 is screwed and fixed to the opening portion formed to the valve chamber 14. By screwing on the nut member 30, the spring 32 is pre-loaded, which supports the valve member 40 through the support member 34 with a predetermined spring force. A seal member 36 is mounted onto the nut member 30 to seal the valve chamber 14.

The refrigerant in the valve chamber 14 travels through the opening portion between the valve member 40 and a valve seat 16 toward a first passage 20. The first passage 20 is communicated through an exit hole 22 to an evaporator not shown.

The refrigerant returning from the evaporator travels through a second passage 50 equipped to the valve body 10, and is circulated again to the compressor not shown. The refrigerant in the second passage is sent through a gap 52 toward a power element 60 mounted to the upper portion of the valve body 10, which acts as a driving mechanism of the valve member.

The power element 60 comprises a body 62 which is mounted to the valve body 10 by a screw portion 64. Further, the element 60 comprises a diaphragm 70 positioned inside the body 62, which defines an upper chamber 72*a* and a lower chamber 72*b*. A working fluid is filled inside the upper chamber 72, and sealed by a plug 66.

The diaphragm 70 is supported by a stopper 74. The stopper 74 is formed either integrally with a heat sensing shaft 80, or separately from the shaft 80. The heat sensing shaft 80 is for transmitting the temperature of a refrigerant flowing through the second passage 50 to the power element 60. A resin 82 having low heat conductivity may be coated to the outer surface of the heat sensing shaft 80, so as to adjust the shaft 80 to have the necessary heat conductivity.

A valve drive member 90 is contacted to the lower area of the heat sensing shaft 80, which biases the valve member 40 in the direction separating from the valve seat 16. The heat sensing shaft 80 is equipped with an o-ring 86 acting as a sealing member preventing communication between the first passage 20 and the second passage 50.

The expansion valve 1 is formed as explained above, so according to the operating position of the diaphragm 70 set according to the pressure and the temperature of the refrigerant traveling through the second passage 50, the heat sensing shaft 80 and the valve member driving element 90 is moved, and the gap between the valve member 40 and the valve seat 16 is adjusted.

When the heat load of the evaporator is great, the gap between the valve member 40 and the valve seat 16 is widened, so that a large amount of refrigerant is supplied to the evaporator, and in contrast, when the heat load is small, the flow of the refrigerant is reduced.

When the heat load is extremely small, the valve member 40 is either in a closed state or a nearly closed state, and there is fear that the refrigerant circulating through the whole refrigeration cycle may be insufficient to lubricate the compressor and the like sufficiently.

The expansion valve according to the present invention is equipped with a function to supply the minimum necessary amount of refrigerant through a bypass passage toward the evaporator even when the valve member is in a closed state or in a nearly closed state.

As shown in FIGS. 2 and 3, to the side surface of the valve body 10 are mounted an electromagnetic valve 100 and a pressure switch 200.

The electromagnetic valve 100 comprises a casing 110 and a mounting member 140 connected to the casing 110. The mounting member 140 is fixed through a screw portion to an opening 26 with a bottom formed to the valve body 10. The opening 26 with a bottom is communicated through a narrow hole 24 to the valve chamber 14.

Therefore, the refrigerant supplied to the valve chamber 14 is introduced to the opening 26 with a bottom through the narrow hole 24, and a bypass passage to the first passage 20 is formed through a passage 27.

The electromagnetic valve 100 comprises a coil 120 placed inside the casing 110, and power is supplied thereto through a cord 122. A cylinder 124 is positioned in the center area of the casing 110, and a plunger 130 is slidably inserted thereto. A stopper 132 is fixed to the outside of the cylinder by a screw 136. The stopper 132 biases the plunger 130 through a spring 134 so that the plunger is biased away from the stopper 132 regularly.

A pilot valve 150 is slidably mounted to the tip of the plunger 130. The pilot valve 150 has a valve hole 152 formed to the center area thereof.

A pipe-like conduit 28 is formed to the center of the opening 26 with a bottom. A passage 27 of the inner diameter of the conduit 28 communicates the opening 26 and the first refrigerant passage 20 of the valve body.

The pilot valve 150 is regularly pressed by the plunger 130, and the plunger 130 shuts the valve hole 152 of the pilot valve 150 with its tip portion. Refrigerant from the opening 26 is introduced to a backing pressure chamber 160 formed outside the pilot valve 150, and by the backing pressure, the pilot valve 150 is pressed against the opening of the conduit 28 and closes its passage 27.

When power is supplied to the coil 120 of the electromagnetic valve 100, the plunger 130 is pulled back toward the stopper 132 by the magnetic force of the coil 120. When the tip of the plunger 130 moves away from the valve hole 152 of the pilot valve 150, the valve hole 152 is opened, and the refrigerant in the backing pressure chamber 160 travels through the valve hole 152 into the passage 27 of the conduit 28, and the pressure difference is reduced. The pilot valve 150 thereby moves away from the end of the conduit 28, and the refrigerant in the opening 26 flows toward the first passage 20.

By such function, the refrigerant may be supplied to the evaporator even when the valve means 40 is in a position closing the valve seat 16.

An opening 54 communicated to the second refrigerant passage 50 is formed to the valve body 10, and a pressure switch 200 is mounted thereto.

The pressure switch 200 comprises a mounting base 210 and a switch case 220, and the switch 200 is screwed onto the opening 54 through a seal member 214 of the mounting base 210. The mounting base 210 comprises a penetrating hole 212, through which the refrigerant in the second passage 50 travels.

A fixed contact 250 and a movable contact 262 supported by a spring 260 is mounted inside the switch case 220.

A diaphragm 230 sandwiched inside the switch case 220 operates the spring 260 through a working member 242 mounted slidably to the supporting member 240.

The refrigerant in the second passage 50 of the valve body 10 is introduced through the opening 54 and the penetrating hole 212 of the mounting base 210 to a pressure chamber 232 formed to one side of the diaphragm. When the pressure of the refrigerant in the pressure chamber 232 is larger than a predetermined value, the center of the diaphragm 232 moves toward the right side of the drawing. By the movement, the working member 242 pushes the spring 260, and separates the movable contact 262 from the fixed contact 250.

Therefore, while the pressure of the refrigerant in the second passage 50 is higher than the predetermined value, the contacts are opened, and no current flows between lead wires 270 and 272.

When the heat load of the evaporator is reduced, the valve member 40 moves in the direction closing the valve, and the pressure of the refrigerant flowing through the second passage 50 decreases. Upon receiving such change in pressure, the diaphragm 230 of the pressure switch 200 moves toward the left side of the drawing. By the movement, the spring 260 moves the movable contact 262 so that it contacts the fixed contact 250.

When contacts 250 and 262 are closed, current flows through the lead wires 270 and 272. The current is transferred through a controller not shown in the drawing to the electromagnetic valve 100. The coil 120 of the electromagnetic valve 100 is biased and opens the pilot valve 150, and thereby, the refrigerant in the valve chamber 14 is flown into the first passage 20 through the conduit 28. Further, in FIG. 3, reference numbers 101 and 102 denote bolt holes for mounting the expansion valve to a predetermined position.

Figure 4:
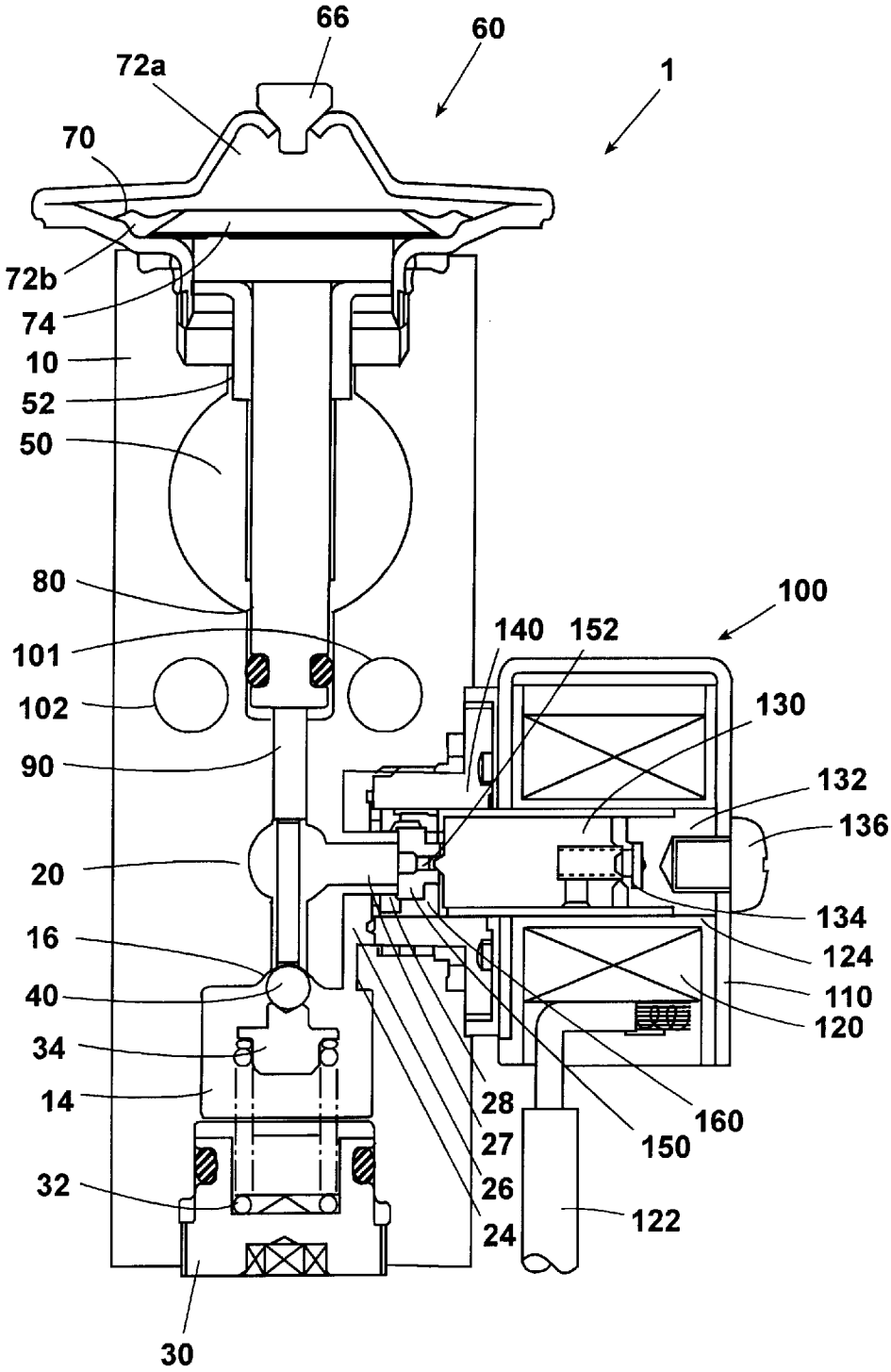
FIG. 4 is a cross-sectional view showing another embodiment of the expansion valve according to the present invention.

In the above explanation, a case is explained where the change in pressure during a low load level is sensed by the pressure switch for opening the bypass passage. However, the present invention is not limited to using a pressure switch for sensing the change in pressure, but a pressure sensor may be utilized instead of the pressure switch for opening the bypass passage by the output of the pressure sensor. FIG. 4 is a cross-sectional view showing such embodiment of the present invention, wherein the change in pressure during low load is sensed before opening the bypass passage. That is, the pressure switch utilized in the embodiment shown in FIG. 2 is not used for operating the electromagnetic valve. In FIG. 4, the same reference numbers as FIG. 2 denote the same or equivalent members. The change in pressure is sensed by a pressure sensor (not shown) which is for example mounted on a discharge pipe of a compressor for sensing the discharge pressure of the compressor. The sensed result is outputted to a controller (not shown), where it is determined whether the output is a predetermined air-conditioning load or not. When the air-conditioning load is of a predetermined value, the output from the controller is inputted to the electromagnetic valve 100, and power is supplied to the electromagnetic valve 100. After the power is supplied, the refrigerant flows through a bypass passage into the first passage by the same operation as the valve shown in FIG. 2.

Moreover, the present invention may also be applied to a valve where the change in temperature during the low load is detected, instead of the change in pressure detected by the pressure sensor explained above, for opening the bypass passage. In other words, a temperature sensor (not shown) for sensing the temperature at the blow-out opening of the air conditioner on a vehicle and the like may be equipped to the electromagnetic valve 100, and the output from the temperature sensor is inputted to a controller (not shown) . It is determined by the controller whether the air conditioning load is in a predetermined range or not, and if the load is in a predetermined range, the output from the controller is inputted to the electromagnetic valve 100, and power is supplied to the valve 100. After that, similar to the operation of FIG. 2, the refrigerant will be flown into the first passage through the bypass passage.

Figure 5:
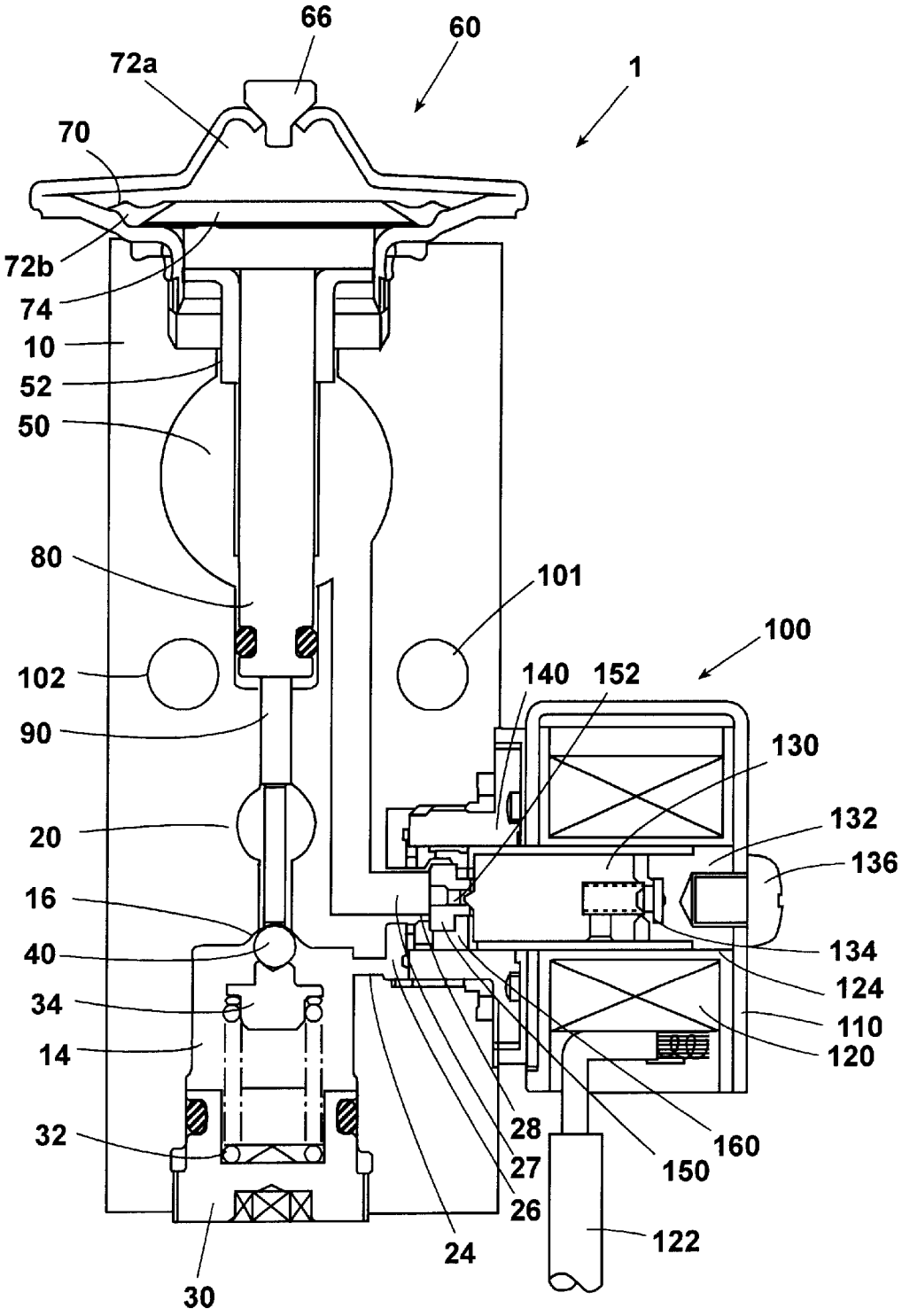
FIG. 5 is a cross-sectional view showing yet another embodiment of the expansion valve according to the present invention.

Even further, according to the present invention, a bypass passage communicating to the first passage is formed to supply the refrigerant to the evaporator. However, the invention is not limited to such example, and may also be applied to cases where the bypass passage is communicated to the second passage, circulating the refrigerant without supplying the refrigerant to the evaporator. FIG. 5 is a cross-sectional view showing such embodiment of the present invention, wherein a passage 56 for communicating the second passage 50 and the bypass passage is formed within the valve body 10.

In FIG. 5, the same reference numbers as the embodiment shown in FIG. 4 denote the same or equivalent members. During a predetermined air-conditioning load, the output from the controller is inputted to the electromagnetic valve 100, and power is supplied to the valve 100. As a result, by the same operation as the embodiment of FIG. 2, refrigerant flows through a bypass passage formed by the narrow hole 24, the opening 26 with a bottom and the passage 27, and travels through a passage 56 toward the second passage 50.

Further, a pressure switch 200 may be utilized in the embodiment of FIG. 5, similarly as in the embodiment of FIG. 2. That is, a pressure switch 200 may be mounted to the valve body 10 through a mounting base 210, and when the contacts of the pressure switch 200 is closed, the refrigerant flows through the passage 56 into the second passage 50 by the same operation as the embodiment of FIG. 2.

According to the expansion valve of the present invention, the minimum necessary amount of refrigerant may be circulated through the bypass passage even when the air-conditioning load becomes very low and the valve is in a closed or nearly closed state. Therefore, the present expansion valve prevents the amount of refrigerant circulating in the refrigeration cycle from becoming too small, which may lead to insufficient lubrication of the compressor and the like.

Moreover, since sufficient lubrication of the equipment in the refrigeration cycle is secured by the present expansion valve, the reliability of the refrigeration cycle may be improved.

We claim:

1. An expansion valve equipped in an air conditioner for decompressing and expanding a refrigerant and supplying the same to an evaporator, wherein:

a valve body comprising a first passage through which said refrigerant being transferred to said evaporator travels, a second passage through which said refrigerant returning from said evaporator toward a compressor travels, and a valve chamber equipped in said first passage into which said refrigerant enters, is further equipped with a bypass passage for supplying said refrigerant from said valve chamber to said compressor, and an electromagnetic valve for opening and closing said bypass passage, said electromagnetic valve being operated so as to open said bypass passage according to the output from a sensing means for detecting a predetermined air-conditioning load.

2. An expansion valve according to claim 1, wherein said bypass passage communicates said valve chamber and said first passage.

3. An expansion valve according to claim 2, wherein said bypass passage communicates said valve chamber and said second passage.

4. An expansion valve according to claim 2 or claim 3, wherein said sensing means is a pressure sensor.

5. An expansion valve according to claim 2 or claim 3, wherein said sensing means is a temperature sensor.

6. An expansion valve equipped in an air conditioner for decompressing and expanding a refrigerant and supplying the same to an evaporator, said expansion valve comprising:

a valve body including a first passage through which said refrigerant being transferred to said evaporator travels and a second passage through which said refrigerant returning from said evaporator travels, a valve chamber formed to said first passage into which said refrigerant enters, a bypass passage for communicating said valve chamber and said first or said second passage, an electromagnetic valve for opening or closing said bypass passage, and a pressure switch equipped to said second passage; wherein said pressure switch detects the reduction of pressure of said refrigerant inside said second passage, and operates said electromagnetic valve to open said bypass passage.

7. An expansion valve according to claim 6, wherein said electromagnetic valve is equipped with a plunger and a pilot valve being opened and closed by the end portion of said plunger, said pilot valve being operated to open or close a conduit formed within said bypass passage.

* * * * *

UNITED STATES PATENT AND TRADEMARK OFFICE

CERTIFICATE OF CORRECTION

PATENT NO. : 6,233,956 B1
DATED : May 22, 2001
INVENTOR(S) : Katayama et al.

It is certified that error appears in the above-identified patent and that said Letters Patent is hereby corrected as shown below:

Title page,
Item [30], Foreign Application Priority Data, please add
-- September 30, 1999 (JP) ……...11-278570 --.

Signed and Sealed this

Thirteenth Day of August, 2002

*Attest:*

*Attesting Officer*

JAMES E. ROGAN
*Director of the United States Patent and Trademark Office*